United States Patent [19]

Senne

[11] Patent Number: 4,836,184

[45] Date of Patent: Jun. 6, 1989

[54] METHOD FOR FUEL ECONOMY

[76] Inventor: Dennis R. Senne, 3124 Leon Rd., Jacksonville, Fla. 32216

[21] Appl. No.: 591,555

[22] Filed: Mar. 20, 1984

Related U.S. Application Data

[60] Continuation of Ser. No. 267,601, May 27, 1981, abandoned, which is a division of Ser. No. 88,166, Oct. 25, 1979, Pat. No. 4,291,671, which is a continuation-in-part of Ser. No. 909,839, May 26, 1978, abandoned.

[51] Int. Cl.[4] ..... F23L 3/00

[52] U.S. Cl. ..... 126/292; 126/285 R; 237/53

[58] Field of Search ..... 237/50, 55, 53; 165/DIG. 2, DIG. 12, 900; 126/292

[56] References Cited

U.S. PATENT DOCUMENTS 589,610 9/1897 McPhaill ..... 126/292

*Primary Examiner*—Henry Bennett

*Attorney, Agent, or Firm*—Patrick H. Hume; Sabin C. Bronson

[57] ABSTRACT

There are disclosed means and method for improving the efficiency of combustion in an automatic gas-fired furnace through retardation, without restriction of the exhaust emission of the products of combustion, which are caused to dwell longer in the combustion chamber to elevate the temperature, not only through the impoundment of what would otherwise be waste heat, but by the conversion of CO gas and excess air to $CO_2$ gas, thus, reducing the two former, increasing the latter, along with temperature. This reduces the condensate in the exhaust chimney. An enlarged chamber in the exhaust gas conduit is incorporated within the line of exhaust flow from furnace to chimney. A baffle plate, approximately equal in area to the cross-sectional area of the conduit, is immovably secured in the chamber normal to the line of exhaust flow. The chamber is completely closed except for the exhaust flow entry and exit ports. The chamber affords clearance beneath or around the baffle for the unimpeded passage of the exhaust gases equal in area, or greater than, that of the exhaust gas conduit.

4 Claims, 1 Drawing Sheet

METHOD FOR FUEL ECONOMY

This application is a continuation of the subject matter disclosed and claimed in the U.S. application of Dennis R. Senne, Ser. No. 267,601, filed May 27, 1981, now abandon for METHOD FOR FUEL ECONOMY, which is a division of U.S. application, Ser. No. 88,166, filed Oct. 25, 1979, now U.S. Pat. No. 4,291,671, which, in turn, is a continuation-in-part of the original U.S. application, Ser. No. 909,839, filed May 26, 1978, for APPARATUS FOR FUEL ECONOMY, of the same applicant, now abandoned.

BACKGROUND AND SUMMARY OF THE INVENTION

This invention relates to improving the combustion efficiency of automatic furnaces. More particularly, this invention relates to an improved method and apparatus for exhausting waste combustion products from an automatic, gas-fired furnace system, to reduce the amount of valuable heat and fuel escaping with the combusted gases.

Furnace systems, such as those used in residential houses, small and large buildings, industry and the like, are often fueled with fuels, such as oil, coal, natural gas and the like. Such furnace systems produce combustion products or flue gases which must be disposed of in the atmosphere through flue gas ductwork.

One disadvantage of such furnace systems is that such flue or combustion gases retain or otherwise have a significant amount of valuable heat, and heat-producing components, derived from fuel combustion. Unless such heat, actual and potential, is recovered, it escapes to the atmosphere and reduces the overall fuel efficiency of the furnace system.

Many devices have been suggested by the prior art to recover some of this energy from furnace system combustion gases. Often, these systems are mere auxiliary heat exchangers, which while being complex, expensive, requiring substantial maintenance, and frequently being too bulky to be compatible with the space requirements, do no more than recover a part of the sensible heat without recovering the latent heat (unspent fuel potential in the exhaust gases). Thus, the average building owner, or resident, who has a furnace system for heating purposes, loses a significant amount of available energy when the combustion gases are exhausted to the atmosphere. Such losses result in reduced furnace efficiency and increased fuel consumption, for a given level of useful heating produced. This is generally true, regardless of whether the furnace is manually or automatically controlled, and regardless of the type of fuel employed. Modern heating systems are, however, preponderantly automatically controlled and operated, and it is toward such systems that the present invention is aimed, especially, automatic, gas-fired systems.

Therefore, one object of the present invention is to provide an improved method and apparatus for exhausting combustion gases from a furnace.

Another object of the present invention is to provide an apparatus and method useful for improving the operating efficiency of a furnace.

A still further object of the present invention is to provide an apparatus to reduce the amount of energy exhausted with the combustion gases from a furnace by impounding waste heat, increasing the $CO_2$ content, lowering the CO and excess air to raise the temperature and lower the condensate in the exhaust chimney.

Other objects and advantages of the present invention will become apparent hereinafter.

An improvement in exhausting combustion gases from a furnace to achieve these objects has now been discovered. One embodiment of the present invention comprises a conduit means in fluid communication with the furnace for conducting combustion gases from the furnace to a chimney, the conduit means being appropriate in size and style to that for which the furnace was designed for voiding combustion gases. Also included is a flow redirection means located within the conduit means in the path of flow of combustion gases within the conduit means. This flow redirection means acts to change the direction of flow of at least a portion of the combustion gases flowing through the conduit means. The flow redirection means is designed so that the cross-sectional area available for gas flow at the location of the flow redirection means is at least as great as the cross-sectional area of the conduit means directly upstream or downstream of the flow redirection means.

The use of the present invention provides surprising benefits. The quantity of heat and uncombusted gases leaving the furnace with the combusted gases is reduced. At least a portion of the heat potential which is not lost in the combustion gases is available for effectively heating a heat-exchanger. In short, improved furnace efficiency, e.g., heating effectiveness, fuel economy, and the like, can be obtained by using the present invention.

The flow redirection means of the present invention may change the direction of only a portion of the combustion gases flowing through the conduit. Preferably, such flow redirection means changes the direction of flow of a major portion, if not all, of such combustion gases.

In a preferred embodiment, the flow redirection means comprises a flow baffle located substantially across the flow of combustion gases in the conduit, so that at least a portion of the gases are caused to flow around the flow baffle; and an added area located in association with the flow baffle provides cross-sectional area available for flow of combustion gases at the location of the flow baffle. In normal use, the flow baffle means is stationary. However, the flow baffle means is removable and replaceable by one of another size so that the amount or fraction of combustion gases redirected by the flow redirection means can be varied depending on the combustion requirements of the individual atmospheric burner.

As noted previously, the cross-sectional area available for the flow of combustion gas at the location of the flow redirection means is at least equal to, or preferably greater than, the cross-sectional area for combustion gas flow in the conduit directly upstream of the flow redirection means.

The cross-sectional area of the conduit for combustion gas flow is preferably substantially constant upstream of the flow redirection means. Preferably, the portion of the conduit down-stream from the flow redirection means also has a substantially constant gas flow cross-sectional area. Usually, the conduit has a substantially circular cross-section normal to the general direction of flow of combustion gases. Additionally, the general direction and volume of combustion gas flow, e.g., in the conduit, is substantially the same both upstream and downstream of the flow redirection means.

In other words, the flow redirection means does not need to permanently change the flow direction or volume of combustion gases in order to perform its function in the present invention.

Under existing public utility and utility associations' standards for automatic gas-fired furnaces, no structure in the exhaust gas conduit, that reduces the effective area of the latter to a lesser area than that for which a furnace or combustion chamber is designed, is permissible during the operational period of the furnace. The present invention meets this requirement by interposing a baffle across the main body of exhaust flow in the effluent conduit from a combustion chamber at an enlarged chamber in said conduit, which, while being hermetically closed to the ambient atmosphere, is capable of receiving and forwarding the full volume of exhaust flow diverted into the chamber by the baffle without restriction or substantial pressure difference. The baffle, in diverting the flow, sets up eddy currents that increase the frictional resistance to the flow of the exhaust gases, causing an acceptable degree of retardation thereof, to effect a dwell in the products of combustion, and a momentary detainment of otherwise waste heat and fuel, in the combustion chamber. The augmented combustion cycle, with enhanced temperature and time parameters thus afforded, causes carbon monoxide (CO) and excess air still resident in the combustion chamber as the result of said baffle, to be converted to carbon dioxide ($CO_2$), an exothermic reaction that further elevates the heat in the system, without regard to new fuel input from the supply source. This reduces excess air in the system, and also reduces condensation in the exhaust effluent.

These and other aspects and advantages of the present invention are set forth in the following detailed description and claims, particularly when considered in conjunction with the accompanying drawings in which like parts bear like reference numerals.

DESCRIPTION OF THE PREFERRED EMBODIMENT

Figure 1:
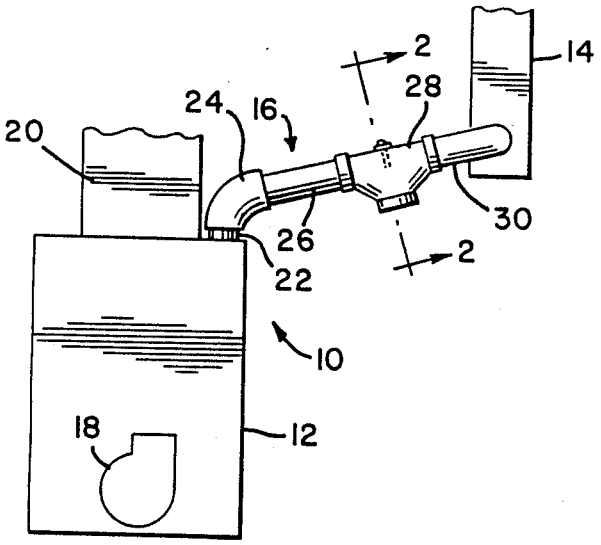
FIG. 1 is a schematic illustration of a system including an embodiment of the present invention.
Figure 2:
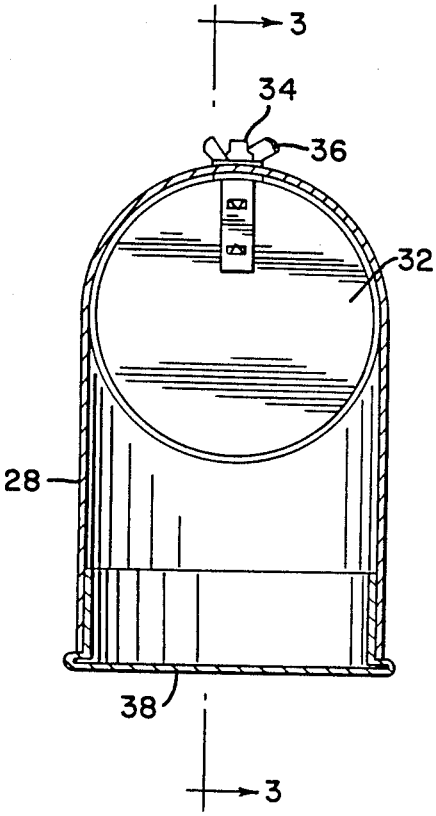
FIG. 2 is a cross-sectional elevational view, taken along line 2—2 of FIG. 1.

Referring now to the drawings, home heating system 10 is shown and includes furnace 12, chimney 14 and ductwork subsystem shown generally at 16 which provides fluid communication between furnace 12 and chimney 14.

Furnace 12 functions as follows: Return cool air, e.g., from the rooms of a house, is drawn into the intake of blower 18 which forces this air through furnace 12 and plenum chamber 20 into the individual rooms of the house to provide warmth. After cooling, the room air is returned to the furnace 12 by the blower 18 and the cycle is repeated. While within the furnace, the cool air from blower 18 is heated by heat exchange with gases produced by the combustion of fuel, e.g., natural gas and air.

The products of combustion or combustion gases, after being subjected to heat exchange with the air which passes into plenum chamber 20, are disposed of, e.g., to the atmosphere, through ductwork subsystem 16 and chimney 14. Thus, the combustion gases exit from furnace 12 through outlet 22, elbow 24, first conduit section 26, tee 28, second conduit section 30 and chimney 14, which exhausts to the outer atmosphere. Outlet 22, elbow 24, first conduit section 26 and second conduit section 30 each has substantially constant and equal cross-sectional areas normal to the general direction of flow of the combustion gases.

Figure 3:
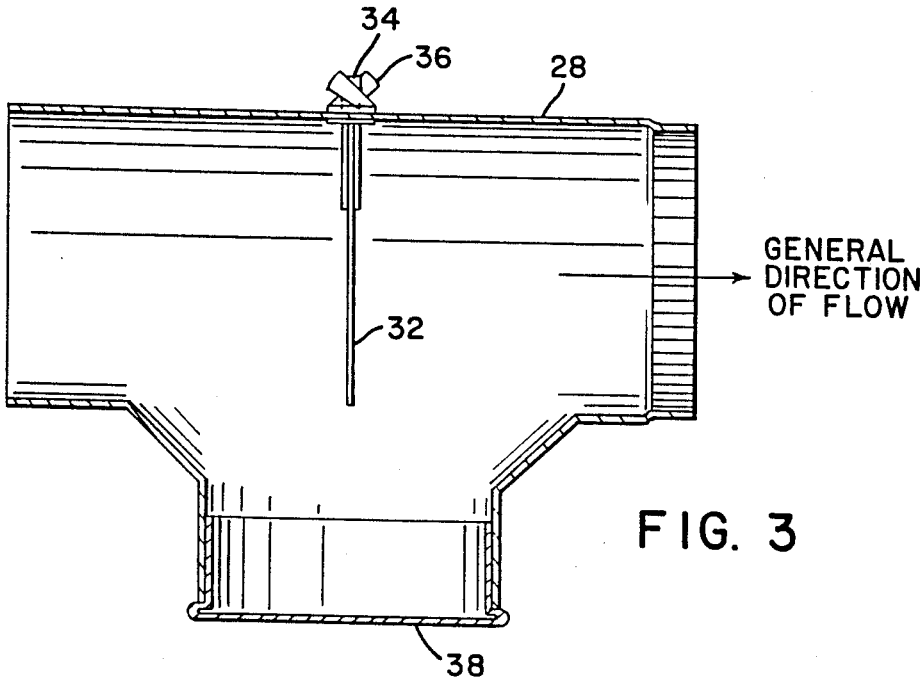
FIG. 3 is a longitudinal sectional elevational view, taken along line 3—3 of FIG. 2.

Tee 28 is crimp-fitted between first conduit section 26 and second conduit section 30. Baffle 32 is removeably secured to the top wall of tee 28 by means of a threaded extention 34 of baffle 32 and wing nut 36. Baffle 32 is placed normal to the general direction of gas flow directly in the center of the path of the combustion gases as these gases flow through first conduit section 26. If desired, the position of baffle 32 can be adjusted by turning threaded extension 34. Baffle 32 may be proportioned so that a minor portion of the combustion gases from first conduit section 26 can pass between the top insides of tee 28 and upper edges of baffle 32, or these parts may be conformed for a seal fit. However, the lower sides and closed bottom of tee 28 are constructed so that the total cross-sectional area normal to the general direction of combustion gas flow (as shown in FIG. 3) and available for gas flow, is at least as large or larger in the plane defined by baffle 32 than the area in either the first conduit section 26, or the second conduit section 30.

The bottom of tee 28 is closed by cap 38. Thus, no extraneous gases, e.g., ambient air, flow into tee 28.

Home heating system 10 and ductwork subsystem 16 function as follows: After room air-combustion gas heat exchange in furnace 12, the room air enters plenum chamber 20 as noted above. The combustion gases flow through outlet 22 into first conduit section 26. As the combustion gases pass through first conduit section 26 and enter tee 28, the flow path of the gases is disturbed by the presence of baffle 32 so that a substantial portion of such gases is forced to flow around baffle 32 before entering second conduit section 30. From second conduit section 30, the combustion gases enter chimney 14 and are exhausted to the outer atmosphere.

The present apparatus and its mode of operation, as described, unexpectedly materially reduced valuable energy loss in the combustion gases exhausted to the atmosphere, and increased combustion efficiency.

Examples I and II

The following examples illustrate, without limitation, the present invention:

Two identical automatic, gas-fired furnaces, Westinghouse Electric Model No. 110 P A, each with a rated heat output of 100,000 BTU hr., were selected for testing.

Furnace No. 1 had a combustion gas exhaust system, as illustrated in the drawings. First and second conduit sections had a diameter of five inches. Baffle 32 was approximately two feet from the outlet 22 and had a substantially circular configuration with a diameter of about five inches. The length of tee 28, from the top wall to the closed bottom was about nine inches.

Furnace No. 2 had a combustion gas exhaust system which did not include a tee 28. A single section of conduit, having a diameter similar to that of the first and second conduit sections, above, was used between furnace outlet 22 and chimney 14.

Each furnace was automatically run in a similar manner, e.g., at the same fuel and combustion air flow rate and house room air flow rate, over the same period of time. Temperature readings were taken at similar locations for each furnace respectively. Results of these tests are summarized as follows:

| | Furnace No. 1 (present invention) | Furnace No. 2 |
|---|---|---|
| Temperature in the chimney, °F. | 140 | 188 |
| Temperature in breeching location in furnace, °F. | 460 | 330 |
| Temperature of air in plenum chamber, °F. | 133 | 110 |

A comparison of the temperature obtained with furnaces 1 and 2 indicates quite clearly that Furnace 1, equipped with the present apparatus, provides more heat per period of fuel to the house. Thus, Furnace No. 1 can be used to heat a house warmer than Furnace No. 2 with a given amount of fuel, or to reduce the amount of fuel required for a given level of heating. In any event, Furnace No. 1 with the present innovative exhaust system provides improved fuel efficiency than does Furnace No. 2 with conventional combustion gas exhaust ductwork.

The invention herein shown and described may be analogized with a dam in a watercourse, where the water is caused to dwell by impoundment behind the dam, from whence it ultimately flows unrestrictedly downstream in the same volume of effluent as its influent upstream of the dam. Such an impoundment can provide for a more efficient use of the water through hydraulic mechanics than could the dynamics of the uninhibited flow of the original stream. In the instant case, the dwell in outflow of otherwise waste gases, decreases carbon monoxide and excess air, increases carbon dioxide, elevates the heat exchanger temperature, without a corresponding fuel input, reduces condensation in the exhaust effluent, and, so, materially increases the combustion efficiency of the system within the proscriptive industry standards of unrestricted exhaust flow.

While this invention has been described with respect to various specific embodiments and examples, it is to be understood that the invention is not limited thereto, and that it can be variously practiced within the scope of the following claims:

I claim:

1. The method of improving the efficiency of combustion of hydrocarbon fuel in a heat-exchanger automatic furnace system, having an exhaust conduit for the venting of the products of combustion that includes:

(1) retarding the flow of said products of combustion by interposing a fixed baffle in said exhaust conduit, (2) providing an unrestricted area of flow around said baffle substantially equal to or greater than that of said exhaust conduit, and in stream with the latter, while (3) excluding ambient and other extraneous gases therefrom, (4) said retardation of flow effecting a dwell in the exhaust of waste heat and products of combustion from said system, thereby (5) augmenting the combustion cycle by enhancing its temperature and time parameters, thus (6) converting an essential part of the residual CO to $CO_2$, so as further to augment the heat in the heat-exchanger system, while (7) reducing condensate in the products of combustion ultimately vented through the exhaust conduit.

2. The invention of claim 1, in which the furnace system is an automatic, gas-fired system.

3. The invention of claim 2, including (1a) Regulating the retardation of flow by adjusting the effective area of said fixed baffle in said exhaust conduit so as to accord with different draft conditions and combustion requirements among different furnace installations.

4. The method of conserving energy and fuel in an automatic fluid-fuel injected heater that includes:

(1) evacuating exhaust gases from the combustion chamber of such a heater;

(2) constituting said exhaust gases into a column of finite longitudinal extent and cross-sectional dimension having a constant unit volume of flow;

(3) abruptly offsetting a preponderance of the exhaust gases constituting said column intermediately of its length laterally into a reentrant bend having a minimum offset substantially approximating the cross-sectional dimension of the column, and a maximum offset sufficient to preserve the unit volume of flow of said column;

(4) maintaining an unrestricted volume of flow along said reentrant bend in said column, while (5) excluding ambient or extraneous gases therefrom;

(6) imposing the effect of said column of exhaust gases upon the atmosphere within the combustion chamber, thereby (7) augmenting its combustion on cycle by enhancing its time/temperature parameters without the input of additional fuel;

(8) converting residual CO and air into $CO_2$, and (9) reducing condensate in the exhaust gases constituting said column.

* * * * *

UNITED STATES PATENT AND TRADEMARK OFFICE

CERTIFICATE OF CORRECTION

PATENT NO. : 4,836,184

DATED : June 6, 1989

INVENTOR(S) : Dennis R. Senne

It is certified that error appears in the above-identified patent and that said Letters Patent is hereby corrected as shown below:

Column 6, line 48, after "combustion", delete "on".

Signed and Sealed this

Thirtieth Day of January, 1990

*Attest:*

JEFFREY M. SAMUELS

*Attesting Officer*

*Acting Commissioner of Patents and Trademarks*